US012116916B1

(12) United States Patent
Koci et al.

(10) Patent No.: US 12,116,916 B1
(45) Date of Patent: Oct. 15, 2024

(54) EXHAUST ASSEMBLY TEMPERATURE REGULATION FOR SHUTDOWN

(71) Applicant: Caterpillar Inc., Peoria, IL (US)

(72) Inventors: Chad Palmer Koci, Washington, IL (US); Chetan Kulkarni, West Lafayette, IN (US); Bradley Hodges, Ft Worth, TX (US); Ryan Matthew Brown, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/407,357

(22) Filed: Jan. 8, 2024

(51) Int. Cl.
*F01N 3/04* (2006.01)

(52) U.S. Cl.
CPC ..... *F01N 3/046* (2013.01)

(58) Field of Classification Search
CPC ..... F01N 3/046
USPC ..... 60/321, 323
See application file for complete search history.

(56) References Cited

U.S. PATENT DOCUMENTS

| | | | | |
|---|---|---|---|---|
| 4,550,694 | A | 11/1985 | Evans | |
| 11,480,092 | B2 | 10/2022 | Toyama | |
| 2013/0206085 | A1* | 8/2013 | Adam | F01N 13/10 123/41.72 |

FOREIGN PATENT DOCUMENTS

| | | | |
|---|---|---|---|
| DE | 102012004954 A1 * | 9/2013 | F01N 13/10 |
| JP | 2010242645 | 11/1985 | |
| JP | 05001539 | 1/1993 | |
| JP | 4845803 | 12/2011 | |
| JP | 2013036448 | 2/2013 | |

* cited by examiner

*Primary Examiner* — Jorge L Leon, Jr.
(74) *Attorney, Agent, or Firm* — Lee & Hayes, P.C.

(57) ABSTRACT

This disclosure describes, in part, systems and structures for an exhaust assembly that includes an exhaust tube and a coolant passage. The exhaust tube is oriented about an axis and an exhaust gas is configured to flow through the exhaust tube in a direction away from an end of the exhaust tube. The coolant passage is oriented about the axis radially outward of the exhaust tube, the coolant passage having an inner shell and an outer shell. The heat capacity of the volume of the coolant contained within the coolant passage is above a threshold ratio of a heat capacitance of a radiation shield, exhaust tube, and inner shell of the coolant passage to prevent coolant boiling after shutdown.

17 Claims, 5 Drawing Sheets

EXHAUST ASSEMBLY TEMPERATURE REGULATION FOR SHUTDOWN

TECHNICAL FIELD

The present application relates generally to gas-powered and other internal combustion engines. More particularly, the present application relates to temperature regulation for exhaust assemblies of gas engines to prevent coolant boiling after shutdown of the gas engines.

BACKGROUND

Internal combustion engines may be configured to convert gasoline, diesel fuel, natural gas, hydrogen gas, landfill gas, or other fuel into mechanical energy. Large-scale internal combustion engines often include water-cooled exhaust manifolds that include a steel shell and case runner. The manifolds for internal combustion engines may fail resulting in coolant leaks into the exhaust system. During normal or steady state operation of the internal combustion engines, the water-cooled exhaust manifolds maintain temperatures of the exhaust systems to within desired levels.

During a hot shutdown of the internal combustion engines (e.g., a sudden, unplanned, unexpected, or immediate shutdown), the coolant may cease to circulate (e.g., due to stopping operation of a coolant pump system) and therefore the coolant may remain stationary within the manifold (e.g., within the jacket). Retaining stagnant coolant within an exhaust manifold while the manifold is at an elevated temperature (e.g., during a hot shutdown) typically results in thermal energy being transferred from the manifold to the coolant, and can result in coolant boiling. Coolant boiling within the manifold results in localized vapor pockets where steel components of the manifold reach high temperatures and results in damage to the manifold. The damage may include cracking, coolant leaks, and other such damage associated with high stresses due to the localized temperature pockets. The rise in the engine and/or exhaust manifold temperature after the engine is turned off may be referred to as heat soak.

An example system for an exhaust assembly including air and/or water-cooling is described in Japanese Patent Publication JPH051539A to Yanagisawa et al., titled "Exhaust Manifold with Cooling Pipe" (hereinafter referred to as "the '539 document"). In particular, the '539 document describes a means to cool exhaust gas in an exhaust manifold to prevent a crack and leak from occurring in the manifold. The '539 document describes installation of an exhaust gas cooling pipe for cooling air or water to flow, preferably having a fin-shape to increase cooling within the manifold. The '539 document further describes the use of an insulator outside of the manifold to prevent heat transfer to a surrounding environment.

Although the system described in the '539 document is configured to provide cooling for an exhaust manifold, it is not able to ensure that coolant (e.g., water) does not boil after a hot shutdown event of the engine that results in stopping a coolant pumping system of the engine (e.g., a water pump of the engine). As a result, the system described in the '539 document is not configured to prevent localized heating within a water-cooled exhaust manifold system or to prevent the subsequent localized overheating, stresses, and/or cracking that may result. Accordingly, the system described in the '539 document may be prone to elevated maintenance costs and premature failure due to damage associated with such localized heating.

Examples of the present disclosure are directed toward overcoming the deficiencies described above.

SUMMARY OF THE INVENTION

The description provided herein includes a liquid cooled exhaust manifold that defines a conduit configured to direct a hot gas from an internal combustion engine and convey the hot gas to a destination. The liquid cooled exhaust manifold has a coolant sleeve concentrically positioned about the conduit. The liquid cooled exhaust manifold includes an inner shell and an outer shell that enclose a coolant volume. The liquid cooled exhaust manifold may be defined at least in part by a ratio defining a relationship of first heat capacity of coolant forming the coolant volume to second heat capacity of metal forming the exhaust manifold (e.g., an inner shell of a coolant volume, radiation shell, exhaust tube, and any other hot metal of components between the exhaust path and the coolant volume) is above a threshold. The ratio may include a second relationship of a mass of the coolant to a mass of a radiation shield positioned concentrically within the coolant sleeve and about the conduit and the inner shell. The ratio may include a third relationship of a first heat capacity of the coolant to a second heat capacity of the metal forming the inner shell. In some examples, the ratio is greater than three to one. The ratio may be greater than three and one-half to one. The threshold for the ratio is determined based at least in part on a simulation of heat transfer through the conduit during a shutdown event of an engine system.

A system described herein includes a liquid cooled component having a conduit configured to receive an exhaust gas and direct the exhaust gas from a source to a destination along an axis. The liquid cooled component may also have a radiation shield positioned concentrically about the axis radially outward of the conduit and a liquid passage positioned concentrically about the axis and radially outward of the radiation shield. The conduit includes an inner shell and an outer shell that enclose a coolant volume. The liquid cooled component may be defined at least in part by a ratio defining a relationship of first heat capacity of coolant forming the coolant volume to second heat capacity of metal forming the components between the coolant volume and the exhaust path is above a threshold. The radiation shield may define one or more holes arranged along a length of the radiation shield to reduce a mass thereof. The ratio may include a second relationship of a mass of the coolant to a mass of the radiation shield and the inner shell. The ratio may include a third relationship of a first heat capacity of the coolant to a second heat capacity of the metal forming the radiation shield and the inner shell. The metal may include a first metal forming the radiation shield and a second metal forming the inner shell. The ratio is greater than three to one. The ratio is greater than three and one-half to one. The threshold for the ratio is determined based at least in part on a simulation of heat transfer through the conduit during a shutdown event of an engine system.

One general aspect includes a system including an internal combustion engine and an exhaust manifold with a conduit concentric with an axis, where an exhaust gas is configured to flow through the conduit away from the internal combustion engine. The exhaust manifold may include a radiation shield positioned concentrically about the axis radially outward of the conduit and a coolant passage positioned concentrically about the axis radially outward of the radiation shield, the coolant passage including an inner shell and an outer shell that define a coolant volume. The exhaust manifold is defined at least in part by a first ratio defining a relationship of first heat capacity of coolant in the coolant passage to second heat capacity of metal forming components between the coolant volume and the exhaust path such as the radiation shield and/or inner shell is above a threshold. The radiation shield may define one or more holes arranged along a length of the radiation shield. The radiation shield may be formed of a first metal having a third heat capacity and the coolant passage may be formed of a second metal having a fourth heat capacity, where the second heat capacity is based on a proportion of a first mass of the radiation shield to a second mass of the coolant passage. The first ratio may include a second relationship of a mass of the coolant to a mass of the radiation shield and the inner shell. The first ratio may include a third relationship of a first heat capacity of the coolant to a second heat capacity of the metal forming the radiation shield and the inner shell.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Wherever possible, the same reference numbers will be used throughout the drawings to refer to the same or like parts. In the figures, the left-most digit(s) of a reference number identifies the figure in which the reference number first appears.

Figure 1:
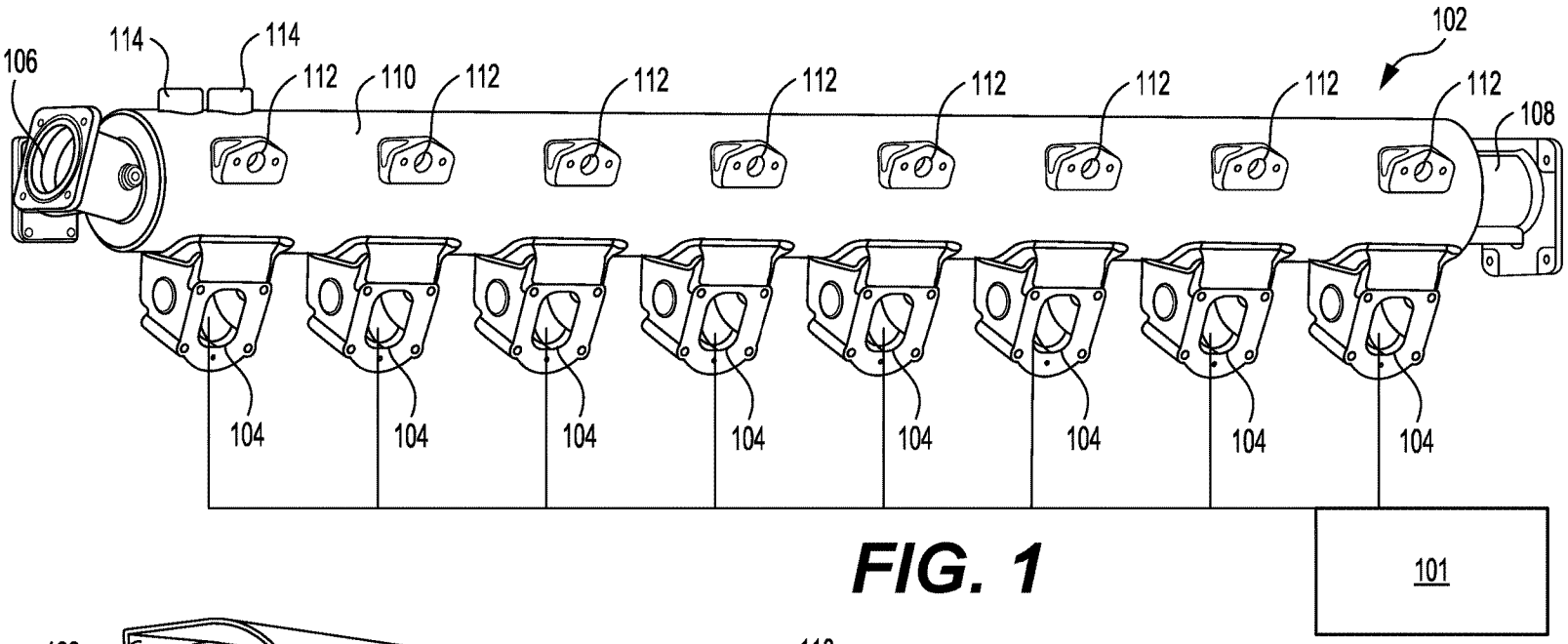
FIG. 1 illustrates an exhaust assembly for an internal combustion engine, according to at least one example.

FIG. 1 illustrates an exhaust manifold 102 for an internal combustion engine 101, according to at least one example. The internal combustion engine 101 may be any engine configured to generate electricity and/or mechanical energy using a gaseous fuel, for example, such as an internal combustion engine. Gaseous fuels are fuels that are in a gaseous state under ordinary conditions such as at standard temperature and pressure. Gaseous fuels may include, for example, methane, ethane, liquified natural gas (LNG), propane, blends of these, and the like.

Though described herein with reference to internal combustion engines, the systems and methods described herein may be implemented with other systems that are water-cooled and may experience a hot shutdown event. For example, such systems may include an exhaust gas recirculation cooler, turbo, and other such systems.

The exhaust manifold 102 may include a water-cooled exhaust manifold to lower surface temperatures of the internal combustion engine 101, for example. The exhaust manifold 102 includes ports 104 for receiving exhaust gases from the internal combustion engine 101, for example through exhaust ports of the engine. The ports 104 provide conduits for exhaust gases to travel from the engine exhaust ports to an exhaust conduit of the exhaust manifold 102. The exhaust manifold 102 provides an exit 106 for transporting exhaust gases away from the internal combustion engine 101 for treatment and/or dispersal. The exhaust manifold 102 also includes a coolant exit 108 for transporting heated coolant away from the exhaust manifold 102.

The exhaust manifold 102 includes a water-cooled sleeve 110 that surrounds a central exhaust conduit. The water-cooled sleeve 110 may be fed by supplies 112 and may have vents 114 to provide coolant circulation into and away from the exhaust manifold 102, for example to transport heat away from the exhaust manifold 102. The water-cooled sleeve 110 contains a coolant volume used to absorb heat energy from the exhaust gases and provide temperature control and cooling of the exhaust manifold 102.

The coolant volume and internal design of the exhaust manifold 102 are configured with a heat capacity ratio of coolant to metal (e.g., describing a ratio of heat capacity of the coolant within the water-cooled sleeve 110 to a heat capacity of the metal components within the exhaust manifold 102, such as components between the coolant volume and the exhaust path).

The exhaust manifold 102 is designed with steel and cast-iron components, in some examples. The coolant may flow into and out of the water-cooled sleeve 110 through the supplies 112. The coolant and/or vapor may vent through vents 114. During operation of the engine, the coolant is actively flowing (e.g., pumped) through the supplies 112 to supply coolant to the water-cooled sleeve 110 and control the temperature of the exhaust manifold 102. When the internal combustion engine 101 is shut down from a full-load or high operating load, the coolant may cease to flow through the supplies 112 (e.g., due to the coolant pump being shutdown by shutdown of the engine) and result in stagnant coolant within the water-cooled sleeve 110.

Accordingly, the exhaust manifold 102, provides for preventing creation of the vapor pockets by having a coolant-to-metal heat capacity ratio such that coolant boiling is avoided. In some examples, heat stored within the exhaust manifold 102 (e.g., within the metal) may be absorbed by coolant without resulting in boiling of the coolant. For instance, the exhaust manifold assembly may have a coolant-to-metal heat capacity ratio that is 3:1 or more, 4:1 or more, or otherwise above a threshold level such that the coolant does not boil during a hot shutdown event. The internal structure of the exhaust manifold 102 may provide for such benefits, as shown in FIG. 2.

Figure 2:
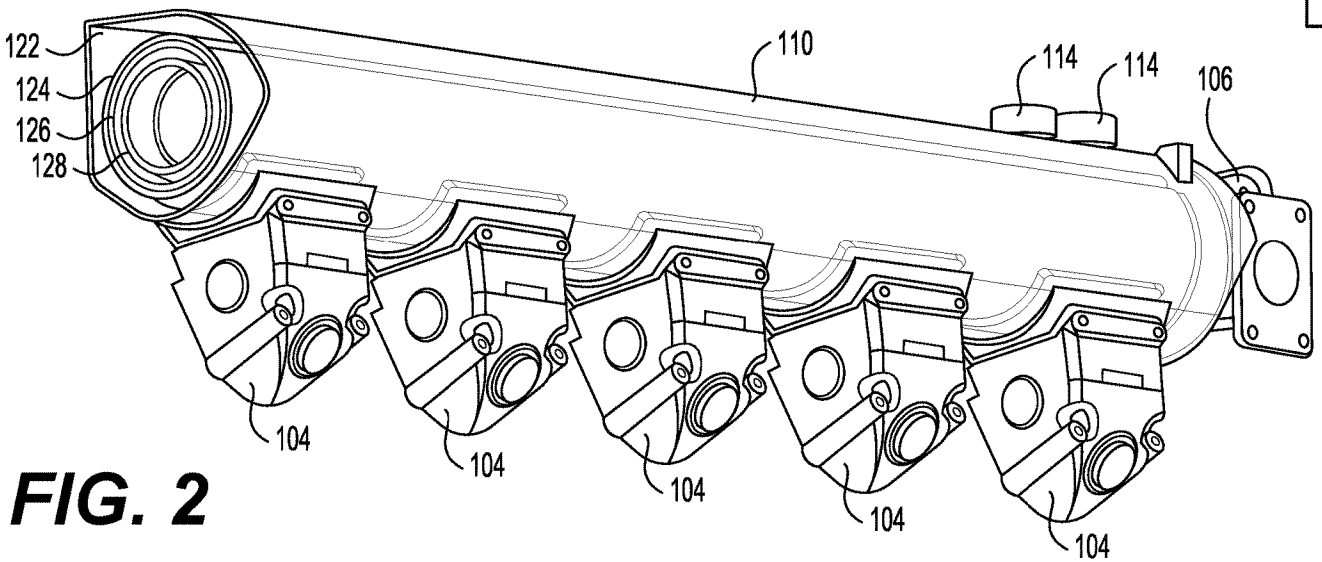
FIG. 2 illustrates a section view of an exhaust assembly for an internal combustion engine according to at least one example.

FIG. 2 illustrates a section view of an exhaust manifold 102, according to at least one example. The exhaust manifold 102 includes, within the water-cooled sleeve 110, an outer shell 122 and an inner shell 124. The outer shell 122 and the inner shell 124 may define a coolant volume (e.g., a space where a volume of coolant resides within the water-cooled sleeve 110). The exhaust manifold 102 is along an axis, e.g., an axis that aligns with or follows the direction of flow of the exhaust within the exhaust manifold 102. Radially within the inner shell 124 there is a radiant shield 126. The radiant shield 126 surrounds an exhaust conduit 128 that carries the exhaust gases from the ports 104 to the exit 106. The radiant shield 126 may be positioned in a space between the exhaust conduit 128 and the water-cooled sleeve 110.

As described herein, the exhaust manifold 102 is designed with a heat capacity ratio comparing the heat capacity of the coolant within the coolant volume to the heat capacity of the components between the coolant volume and the exhaust path such as the inner shell 124, radiant shield 126, and/or the exhaust conduit 128. The heat capacity ratio may be selected as described herein, for example to identify, based on simulation, a heat capacity ratio that reduces the likelihood or eliminates hot shutdown coolant boiling. In some examples, for example with metal components formed of steel, stainless steel, aluminum, titanium, or other such metals, the heat capacity ratio may be greater than three to one, greater than 3.5 to one, greater than four to one, or some other ratio above a threshold.

The heat capacity ratio may be adjusted for the exhaust manifold 102 by designing the water-cooled sleeve 110, radiant shield 126, and/or exhaust conduit 128 with a mass such that the ratio of the heat capacity of the coolant in the coolant volume to the heat capacity of the metal is at or above the desired ratio. In some examples, the mass of the walls for the water-cooled sleeve 110, radiant shield 126, exhaust conduit 128, or other components may be reduced by thinning the walls to reduce the material heat capacity. In some examples, the coolant volume within the water-cooled sleeve 110 may be designed such that the space between the outer shell 122 and the inner shell produces a coolant volume with a greater heat capacity. The coolant volume may be adjusted by increasing the diameter of the outer shell 122, changing the shape of the water-cooled sleeve 110, reducing the diameter of the inner shell 124, and/or any combination of the above.

The heat capacity ratio may be determined for an exhaust manifold 102 (and/or other component with a hot fluid traveling therethrough) by modeling the system based on exhaust (or hot fluid) temperature and heat flux data, a heat transfer model (for example showing heat transfer through conductivity, radiation, and convection), and coolant boiling temperature ranges. A simplified model may be generated to include a heat source (e.g., exhaust gas) with particular temperature and heat flux characteristics based on operating conditions of the internal combustion engine 101. The heat source may then be connected, within the model, through different heat transfer mechanisms to model transfer through conductivity, convection, and radiation. The model may therefore show a heat flux and/or temperature of coolant within the water-cooled sleeve 110 based on the operating conditions of the internal combustion engine 101. Accordingly, the system may be modeled for a shutdown event wherein the coolant is no longer circulated, to ensure that the coolant remains below a boiling range.

In examples and systems described herein, the exhaust manifold 102 may be implemented in any internal combustion engine 101 without requiring any changes to the internal combustion engine 101 or downstream exhaust system. As such, the exhaust manifold assemblies designed with the heat capacity ratios described herein may be retrofitted to existing systems as well as implemented on new systems of internal combustion engines 101.

In some examples, the exhaust manifold 102 may be designed with additional constraints, such as a lowest coolant volume, lowest structural mass, lowest cost of materials in structure, or other such constraints in addition to constraining the design to meet or exceed the ratios defined herein.

Figure 3:
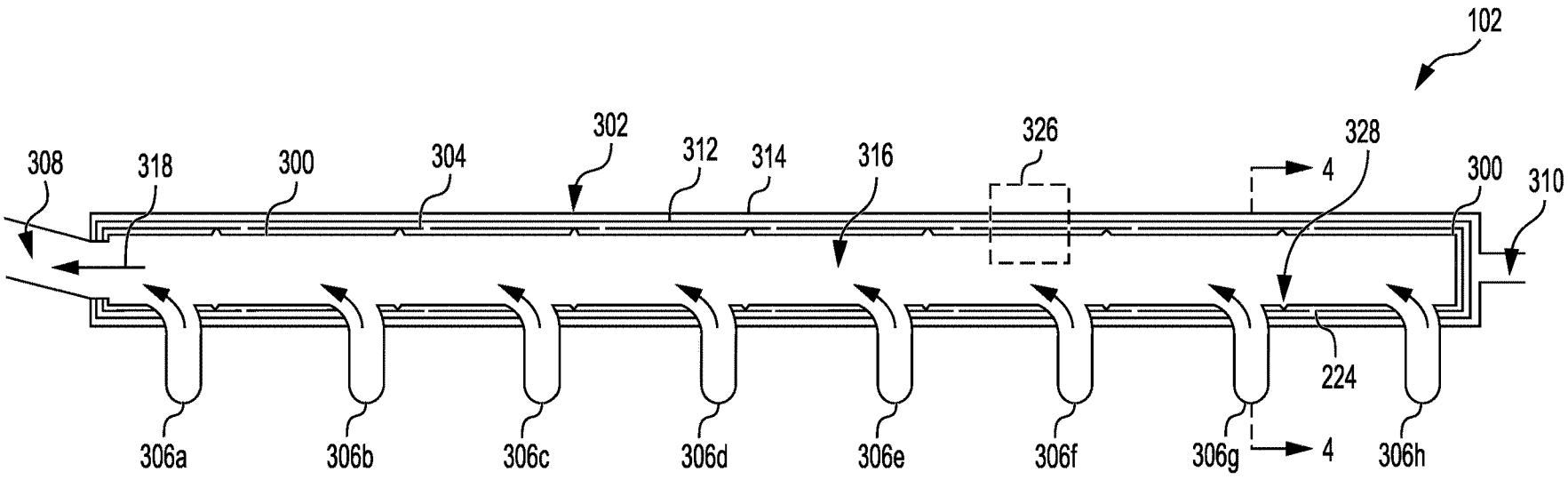
FIG. 3 illustrates a cross-section view illustrating an exhaust assembly for an internal combustion engine, according to at least one example.

FIG. 3 illustrates a cross-section view illustrating an exhaust manifold 102 for an internal combustion engine 101, according to at least one example. The exhaust manifold 102 includes an exhaust tube 300, a coolant passage 302, a radiation shield 304 (which may be optional in some examples), exhaust inlets 306 *a*-306 *h*, an exhaust outlet 308, a coolant outlet 310, and an exhaust passage 316. The coolant passage 302 is formed between an inner shell 312 and an outer shell 314 and is configured to receive a coolant through one or more coolant inlets. The coolant passage 302 may be a water jacket and the coolant may be water or any other liquid or gaseous substance selected to provide cooling for components of the engine. Exhaust gases are received through the exhaust inlets 306 *a*-306 *h*, for example, and flow to the exhaust outlet 308 through the exhaust passage 316.

The exhaust manifold 102 includes one or more holes 224 in the radiation shield 304. The one or more holes of the radiation shield may reduce the mass of the radiation shield 304 and/or may allow for additional heat transfer by convection and/or radiation to the coolant passage 302.

Due to the coolant flowing through the coolant passage 302, the inner shell 312 of the coolant passage 302 may be at a controlled and/or desired temperature during operation. When a shutdown event occurs, the radiation shield 304 and the inner shell 312 increase in temperature due to residual heat from exhaust gases. The coolant is no longer actively pumped through the coolant passage. Due to the relative heat capacity of the coolant versus the radiation shield 304, the main exhaust passage 316, and the coolant passage 302, even with the coolant no longer actively pumped, the coolant absorbs energy as heat without reaching the boiling range for the coolant.

The exhaust manifold 102 is depicted as extending along an axis 318 with the main exhaust passage 316 along the axis 318, the radiation shield 304 radially outward and at least partly surrounding the main exhaust passage 316, and the coolant passage 302 radially outward of the radiation shield 304. The dimensions and relative thicknesses and spacing of the main exhaust passage 316, the radiation shield 304, and the coolant passage 302 are determined based on a ratio defining a relationship of a first heat capacity of coolant forming a coolant volume in the coolant passage 302 to a second heat capacity of metal forming the components between the coolant volume and the exhaust path such as the radiation shield 304 and the inner shell 312 and/or outer shell 314. Specifically, the ratio is determined to be above a threshold, meaning that the coolant is capable of absorbing sufficient energy without reaching a boiling range of the coolant.

The ratio may include a second relationship of a mass of the coolant to a mass of the components between the coolant volume and the exhaust path including the radiation shield and the inner shell. The ratio may include a third relationship of a first heat capacity of the coolant to a second heat capacity of the metal forming the radiation shield and the inner shell. The metal may include a first metal forming the radiation shield and a second metal forming the inner shell. The ratio is greater than three to one. The ratio is greater than three and one-half to one. The threshold for the ratio is determined based at least in part on a simulation of heat transfer through the conduit during a shutdown event of an engine system.

In some examples, the exhaust manifold 102 is defined at least in part by a first ratio defining a relationship of a first heat capacity of coolant in the coolant passage 302 to a second heat capacity of metal forming the components between the coolant volume and the exhaust path including, for example, the radiation shield 304 or inner shell 312 is above a threshold. The radiation shield 304 may be formed of a first metal having a first heat capacity and the coolant passage 302 may be formed of a second metal having a second heat capacity. For determining the ratio, the heat capacity of the metal may be determined based on a weighted average of the heat capacity of the relative components based on their relative masses.

The radiation shield 304 may define one or more holes 224 arranged along a length of the radiation shield 304 to reduce a mass thereof. The radiation shield 304 has a mass that may also be adjusted by changing a material and/or thickness of the radiation shield 304. The radiation shield 304 and the inner shell 312 and/or outer shell 314 may be formed of various materials including various steels, aluminums, cast iron, light metal alloys, or other suitable metals.

Figure 4:
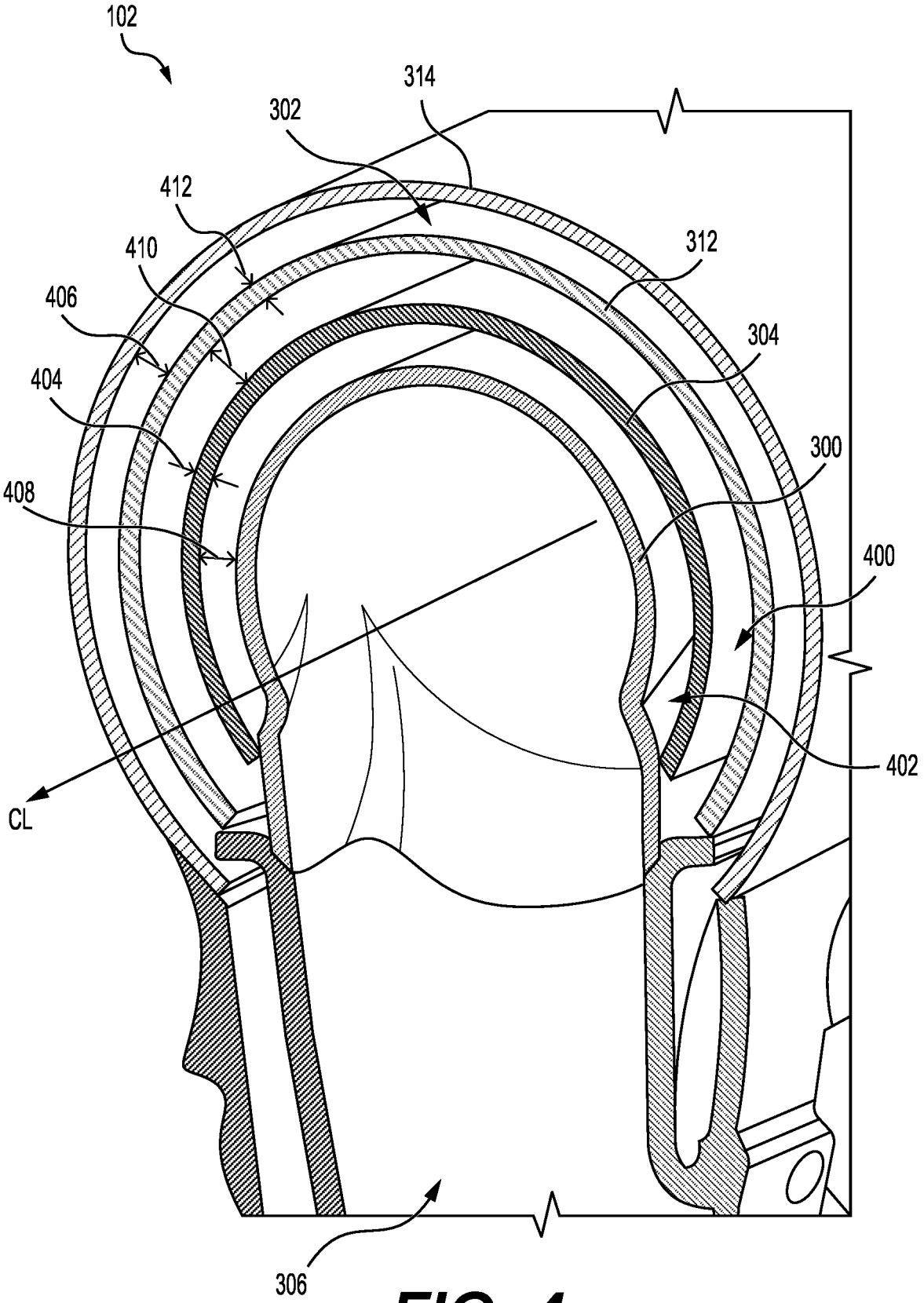
FIG. 4 illustrates a perspective view illustrating a cross-section of an exhaust assembly for an internal combustion engine, according to at least one example.

FIG. 4 illustrates a perspective view illustrating a cross-section of an exhaust manifold 102 for an internal combustion engine 101, according to at least one example. The exhaust manifold 102 includes components described above such as the coolant passage 302, radiation shield 304, exhaust inlets 306, inner shell 312, and outer shell 314. The cross-section is taken along the line 4-4 illustrated in FIG. 3. As seen in FIG. 4, the exhaust tube 300 is oriented annularly about an axis CL. The radiation shield 304 is oriented annularly about the axis CL and radially outward of the exhaust tube 300.

The inner shell 312 of the coolant passage 302 is oriented annularly about the axis CL and radially outward of the radiation shield 304 and the outer shell 314 is radially outward of the inner shell 312. The coolant (water, for example) flows through the coolant passage 302 that may have an annular shape. Exhaust gases may, in some examples, flow through the annular passage 400 between the radiation shield 304 and the inner shell 312, and through the annular passage 402 between the exhaust tube 300 and the radiation shield 304. In such examples, the exhaust tube 300 and/or radiation shield 304 may each define one or more passages, openings, or conduits to enable exhaust gases to travel from the exhaust tube 300 to the interstitial spaces between the exhaust tube 300, radiation shield 304, and inner shell 312.

A first dimension for determining the heat capacity ratio (e.g., by dividing the heat capacity of the coolant by the heat capacity for the metal components forming the internal structure of the exhaust manifold) may include a thickness 404 of the radiation shield 304. A second dimension may include a distance 406 between the inner shell 312 and the outer shell 314, that may be used to calculate an annular volume of the coolant passage 302 as an annular cylinder to determine a coolant volume. A third dimension may include a distance 408 from the exhaust tube 300 to the radiation shield 304. A fourth dimension may include a distance 410 from the radiation shield 304 to the inner shell 312. A fifth dimension may include a thickness 412 of the inner shell 312 which may or may not be the same as the thickness of the outer shell 314.

The heat capacity of the coolant may be determined based on the coolant volume, as determined based on the distance 406 and the length of the exhaust manifold 102 to define the annular cylinder of the coolant passage 302. The heat capacity of the internal metal structure of the exhaust manifold 102 may be determined based on the thickness and dimensions of the exhaust tube 300, radiation shield 304, inner shell 312, and optionally the outer shell 314. Accordingly, the ratio discussed herein may be calculated based on the relative dimensions shown in FIG. 4.

In some examples, the exhaust manifold 102 may be adjusted to increase the heat capacity ratio by increasing the distance 406 thereby increasing a volume of the coolant. In some examples, the ratio may be adjusted by changing a shape and/or dimensions (e.g., diameter) of the inner shell 312 and/or outer shell 314 to increase or decrease the ratio. In some examples, the ratio may be increased to exceed a threshold, such as a threshold ratio of 3:1, 3.5:1, 4:1, or more. In some examples, the ratio may be maintained within a range such that the material costs, weight, and dimensions of the exhaust manifold 102 remain within other system constraints.

Figure 5:
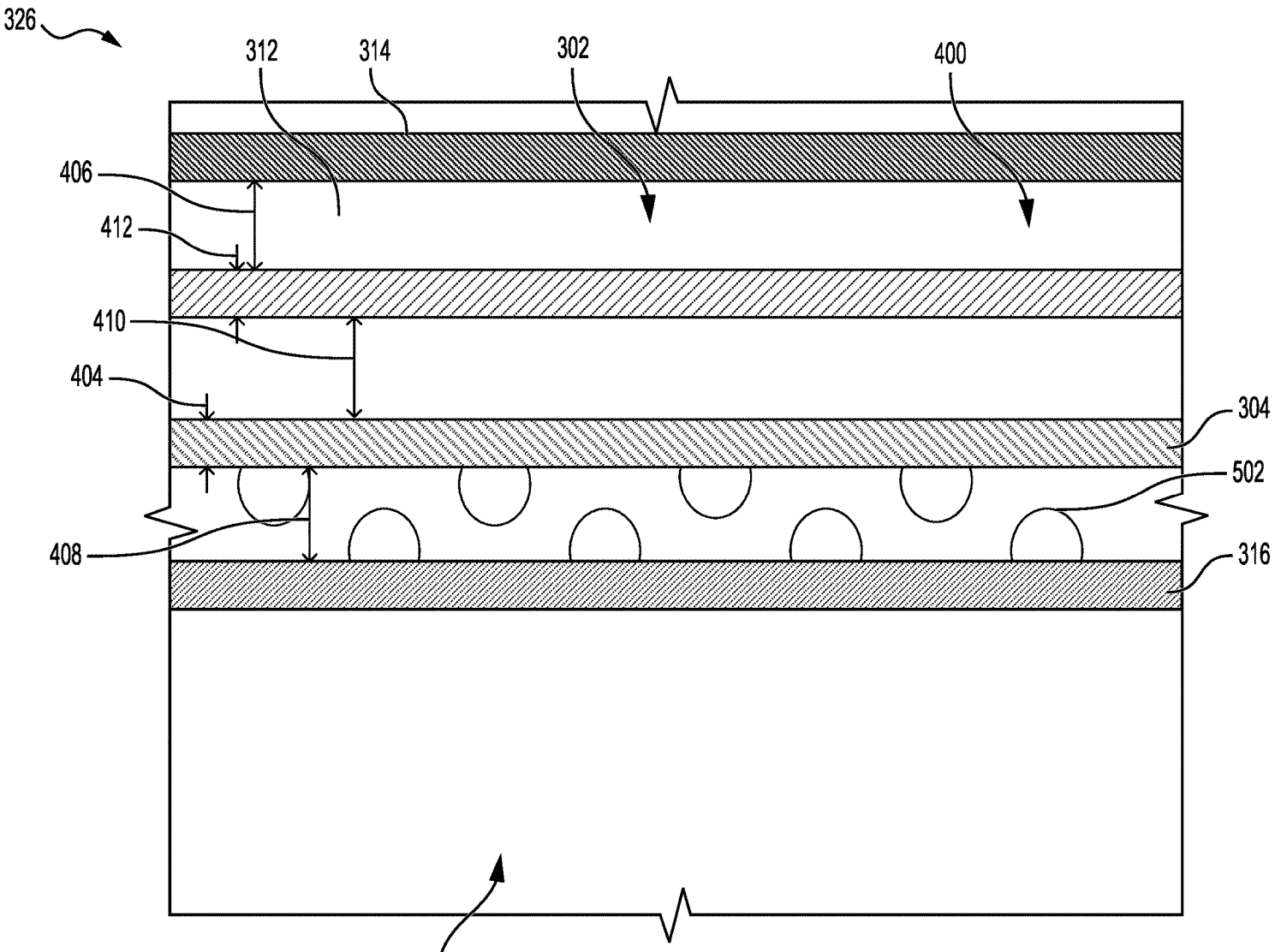
FIG. 5 illustrates a cross-section view illustrating a portion of an exhaust assembly, according to at least one example.

FIG. 5 illustrates a cross-section view illustrating a portion 326 of an exhaust manifold 102, according to at least one example. The portion 326 shows the elements of the exhaust manifold 102 described herein including the exhaust tube 300, coolant passage 302, radiation shield 304, inner shell 312, outer shell 314, dimensions and thicknesses of the relative internal structural elements as described with respect to FIG. 4, as well as optional elements of the radiation shield 304, such as holes 502. The holes 502 may enable exhaust gases to transit between the space between the radiation shield 304 and the exhaust tube 300 to the space between the radiation shield 304 and the inner shell 312. The holes 502 may also be used to alter a mass of the radiation shield 304, for example to change the mass and therefore the heat capacity of the radiation shield 304. The spacing, arrangement, size, and shape of the holes 502 may be variable based on different designs and configurations.

Figure 6:
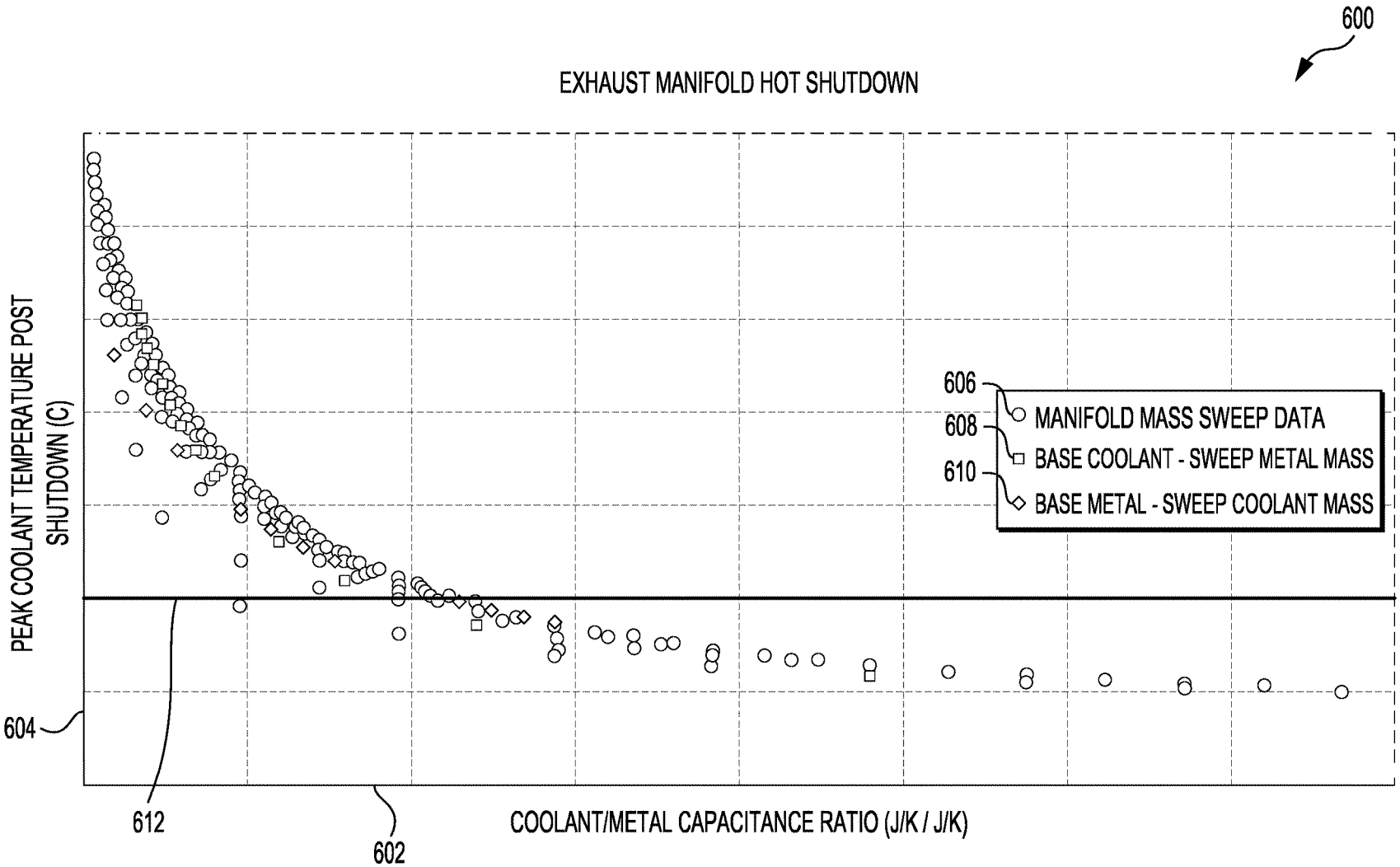
FIG. 6 illustrates a chart depicting a relationship between peak coolant temperature after shutdown and a ratio of coolant to metal heat capacity for an exhaust assembly, according to at least one example.

FIG. 6 illustrates a chart 600 depicting a relationship between peak coolant temperature 604 after shutdown and a ratio 602 of coolant to metal heat capacity for an exhaust assembly, according to at least one example. The ratio 602 may include the ratio defined above and relate to a relationship of first heat capacity of coolant forming a coolant volume in the coolant passage 302 to second heat capacity of metal forming the radiation shield 304 and the inner shell 312 and/or outer shell 314. Specifically, the ratio is determined to be above a threshold, meaning that the coolant is capable of absorbing sufficient energy without reaching a boiling range of the coolant.

The ratio may include a second relationship of a mass of the coolant to a mass of the components between the coolant volume and the exhaust path including, for example, the radiation shield and the inner shell. The ratio may include a third relationship of a first heat capacity of the coolant to a second heat capacity of the metal forming the radiation shield and the inner shell. The metal may include a first metal forming the radiation shield and a second metal forming the inner shell. The ratio is greater than three to one. The ratio is greater than three and one-half to one. The threshold for the ratio is determined based at least in part on a simulation of heat transfer through the conduit during a shutdown event of an engine system.

In some examples, the exhaust manifold 102 is defined at least in part by a first ratio defining a relationship of first heat capacity of coolant in the coolant passage 302 to second heat capacity of metal forming the radiation shield 304 or inner shell 312 is above a threshold. The radiation shield 304 may be formed of a first metal having a first heat capacity and the coolant passage 302 may be formed of a second metal having a second heat capacity. For determining the ratio, the heat capacity of the metal may be determined based on a weighted average of the heat capacity of the relative components based on their relative masses.

The chart 600 may be generated using a simulation of the exhaust manifold 102 in a hot shutdown condition from a steady state operating condition. In particular, the chart 600 may be generated by using a thermal model of the coolant, coolant shell, radiation shield, exhaust tube, and exhaust gases to model conditions after a hot shutdown event. For example, by using the known heat flux values and temperatures of exhaust gases, a model may be generated to sweep through a range of coolant to metal heat capacity ratios and determine a simulated peak coolant temperature following the shutdown event.

For instance, the model may be generated to account for conduction, convection, and radiation heat transfer within the exhaust manifold and may be determined to calculate, using a model, the peak coolant temperature following shutdown. In some examples, the simulation may be performed using a lumped capacity model. The lumped capacity model or lumped system analysis may be used to reduce the system of the exhaust manifold to discrete lumps representing the exhaust gases, exhaust tube, radiation shield, coolant shell, and coolant. The lumped capacity model assumes that the temperature difference inside each lump is negligible and may be used to approximate the peak coolant temperature 604.

After a model is generated, the data series 606, 608, and 610 may be generated by fixing a mass of the metal components, fixing a mass of the coolant, or otherwise varying the ratio and determining the peak coolant temperature from the model. The resulting data is included in chart 600. Once the data is generated, a range of ratios may be identified based on identifying or determining a coolant boiling point or range.

Once the coolant boiling point is known, the threshold 612 may be selected either at or below the coolant boiling point temperature, such that the peak temperature of the coolant post shutdown does not reach the boiling point, per the model. Accordingly, a ratio of coolant to metal capacity that results in a peak coolant temperature below the threshold 612 may be used for sizing the components of the exhaust manifold 102. The sizing may be performed by determining the range of ratios, e.g., underneath the threshold 612, and determining metal thicknesses, distances, and coolant volumes (such as shown in FIG. 4) that maintain a ratio within the acceptable range (e.g., under the threshold) and also meet any other additional constraints such as cost, size, weight, or other conditions for the system. In this manner, the design may be parametrized, and once a range of ratios is identified, parametric modeling may be used to produce a set or plurality of possible dimensions, thicknesses, and configurations that satisfy the threshold 612 condition. Other factors, such as mentioned above, may be used to select from among the parametrized designs.

INDUSTRIAL APPLICABILITY

The present disclosure provides systems and methods for preventing coolant boiling in post-shutdown environments of water-cooled exhaust manifolds to reduce damage to parts and components.

Accordingly, the exhaust manifold assembly described herein, provides for preventing creation of the vapor pockets by having a coolant-to-metal heat capacity ratio such that coolant boiling is avoided. Accordingly, heat stored within the exhaust manifold assembly (e.g., within the metal) may be absorbed by coolant without resulting in boiling of the coolant. In some examples, the exhaust manifold assembly may have a coolant-to-metal heat capacity ratio that is 3:1 or more, 4:1 or more, or otherwise above a threshold level such that the coolant does not boil during a hot shutdown event.

In one illustrative example, the engine may be a Caterpillar® G3500 engine used to convert fuel into electrical energy. The engine includes a water-cooled exhaust manifold. The manifold includes an exhaust tube defining a main exhaust passage. The exhaust tube includes one or more holes in the end of the tube opposite an exhaust outlet. The exhaust enters the manifold through several exhaust inlets and flows from the inlets to the exhaust outlet. A water jacket is oriented radially outward of the exhaust tube and configured to carry water to provide cooling for exhaust surfaces. The water jacket and exhaust tube may be separated by a radiation shield. The exhaust flows from the hole, through the passage, to the exhaust outlet during steady state operation of the engine. After a hot shutdown event, the water jacket contains coolant having a heat capacity capable of absorbing residual heat without boiling the coolant and preventing associated damage to engine components.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An exhaust assembly comprising:

an exhaust tube defining a central axis, the exhaust tube configured to direct an exhaust gas away from an engine to which the exhaust tube is fluidly connected; and a coolant passage concentrically arranged about the exhaust tube, the coolant passage including an inner shell and an outer shell collectively defining a coolant volume, wherein a first ratio of a first heat capacity of coolant in the coolant passage to a second heat capacity of metal forming the exhaust tube is greater than a first threshold so as to prevent boiling of the coolant in the coolant passage after engine shutdown.

2. The exhaust assembly of claim 1, further comprising a radiation shield concentrically arranged between the exhaust tube and the coolant passage, the radiation shield defining one or more holes arranged along a length of the radiation shield.

3. The exhaust assembly of claim 1, wherein a second ratio of a mass of coolant in the coolant volume to a mass of the inner shell is greater than a second threshold.

4. The exhaust assembly of claim 1, wherein the first threshold is greater than 3:1.

5. The exhaust assembly of claim 1, wherein the first threshold is greater than 3.5:1.

6. The exhaust assembly of claim 1, wherein the first threshold is based at least partly on a simulation of heat transfer through the exhaust tube during a shutdown event of the engine.

7. A liquid cooled component comprising:

a conduit configured to convey an exhaust gas from a source to a destination along an axis;

a radiation shield concentrically arranged about the conduit along the axis; and a liquid passage concentrically arranged about the radiation shield, the liquid passage including an inner shell and an outer shell enclosing a coolant volume, wherein a first ratio of a first heat capacity of coolant in the coolant volume to a second heat capacity of metal forming the radiation shield and the inner shell is greater than a first threshold.

8. The liquid cooled component of claim 7, wherein the radiation shield defines one or more holes arranged along a length of the radiation shield.

9. The liquid cooled component of claim 7, wherein a second ratio of a mass of the coolant to a mass of the radiation shield and the inner shell is greater than a second threshold.

10. The liquid cooled component of claim 7, wherein the metal includes a first metal forming the radiation shield, and a second metal forming the inner shell.

11. The liquid cooled component of claim 7, wherein the first ratio is greater than 3:1.

12. The liquid cooled component of claim 7, wherein the first ratio is greater than 3.5:1.

13. The liquid cooled component of claim 7, wherein the first threshold is based at least partly on a simulation of heat transfer through the conduit during a shutdown event of an engine system.

14. A system comprising:

an internal combustion engine; and an exhaust assembly fluidly connected to the internal combustion engine, the exhaust assembly including:

a conduit extending along an axis, the conduit configured to convey an exhaust gas away from the engine;

a radiation shield concentrically arranged about the conduit along the axis; and a coolant passage concentrically arranged about the radiation shield, the coolant passage including an inner shell and an outer shell collectively defining a coolant volume, wherein a first ratio of a first heat capacity of coolant in the coolant passage to a second heat capacity of metal forming the radiation shield and the coolant passage is greater than a threshold.

15. The system of claim 14, wherein the radiation shield defines one or more holes arranged along a length of the radiation shield.

16. The system of claim 14, wherein the radiation shield is formed of a first metal with a third heat capacity, and the coolant passage is formed of a second metal with a fourth heat capacity, wherein the second heat capacity is based on a ratio of a first mass of the radiation shield to a second mass of the coolant passage.

17. The system of claim 14, wherein a second ratio of a mass of the coolant to a mass of the radiation shield and the coolant passage is greater than a second threshold.

* * * * *